US005941522A

United States Patent [19]

Hagstrom et al.

[11] Patent Number: 5,941,522

[45] Date of Patent: Aug. 24, 1999

[54] PRINTER WITH AUXILIARY OPERATION

[75] Inventors: Erick Hagstrom, Hamel; Matthew K. Dunham, Eagan; Darren W. Haas, Hopkins, all of Minn.

[73] Assignee: Fargo Electronics, Inc., Eden Prairie, Minn.

[21] Appl. No.: 08/854,969

[22] Filed: May 13, 1997

[51] Int. Cl.[6] ..... B65H 5/00

[52] U.S. Cl. ..... 271/225; 271/186; 271/300; 271/302; 271/902

[58] Field of Search ..... 271/300, 302, 271/902, 225, 184–186, 10.11, 10.09, 10.01, 4.1, 4.08, 4.01

[56] References Cited

U.S. PATENT DOCUMENTS 5,332,889 7/1994 Lundstrom et al. ..... 235/380
5,381,209 1/1995 Binder et al. ..... 271/302 X
5,709,484 1/1998 Dorner ..... 400/188

FOREIGN PATENT DOCUMENTS 0 739 744 A2 10/1996 European Pat. Off. .
5-159531 6/1993 Japan .

*Primary Examiner*—David H. Bollinger
*Attorney, Agent, or Firm*—Westman, Champlin & Kelly, P.A.

[57] ABSTRACT

An identification card processor receives cards from a hopper, and passes them through a graphic imager for printing, and either prior to printing or subsequently the cards are positioned on an index table that permits moving the cards about an axis to different positions for further operations. The further operations take place at locations set off from the plane of movement of the cards in the graphics imager to conserve space. The indexing table is capable of being indexed to any desired rotational position in a full 360° of movement, and for moving a card under positive drive to and from the index table.

21 Claims, 6 Drawing Sheets

61
57
54
71
74A
82
86
88
81
64
69
74
58
88
86
44
42
62

PRINTER WITH AUXILIARY OPERATION

BACKGROUND OF THE INVENTION

The present invention relates to a printer or other processor for processing information on identification cards and including a section that permits transferring the card from the printer or processor to auxiliary devices that perform other operations on the card, such as magnetic encoding or encoding a "smart" card that has a chip embedded therein. The unit is made to be very compact and to permit a wide variety of secondary or auxiliary operations to be performed in a minimum space.

ID card printers have been advanced that can sequentially print on standard size plastic identification cards very rapidly. As the cards become more sophisticated, additional processing on the card such as encoding a magnetic strip on one side of the card, or encoding or enabling a small circuit chip embedded in or on cards that are called "smart" cards.

The printers that have been advanced utilize various types of feeders for the cards to move them from a storage hopper into the printing station, and generally, prior to the present advance, if any auxiliary operations were to be performed, they were essentially an "add on" to the printer frame so that the overall unit increased substantially in length. The cards were merely run on an assembly line so that operations were sequentially done at one level.

SUMMARY OF THE INVENTION

The present invention relates to a card processor, such as a printer for printing identification cards that uses a support and an indexing table for receiving the cards from the first printer or processor station. The indexing table retains the card, and can be used to move the card into a number of different rotational positions, and then feed the card into an additional or auxiliary operation station. The indexing table is capable of rotating a full 360°, and since the cards are planar, the card can be fed along a plane that is at any desired angle relative to the plane of card movement through the printer or first processor. The table indexing includes drive rollers that will drive the card in the desired direction, after rotation to its desired indexed position.

DETAILED DESCRIPTION OF THE PREFERRED EMBODIMENTS

Figure 1:
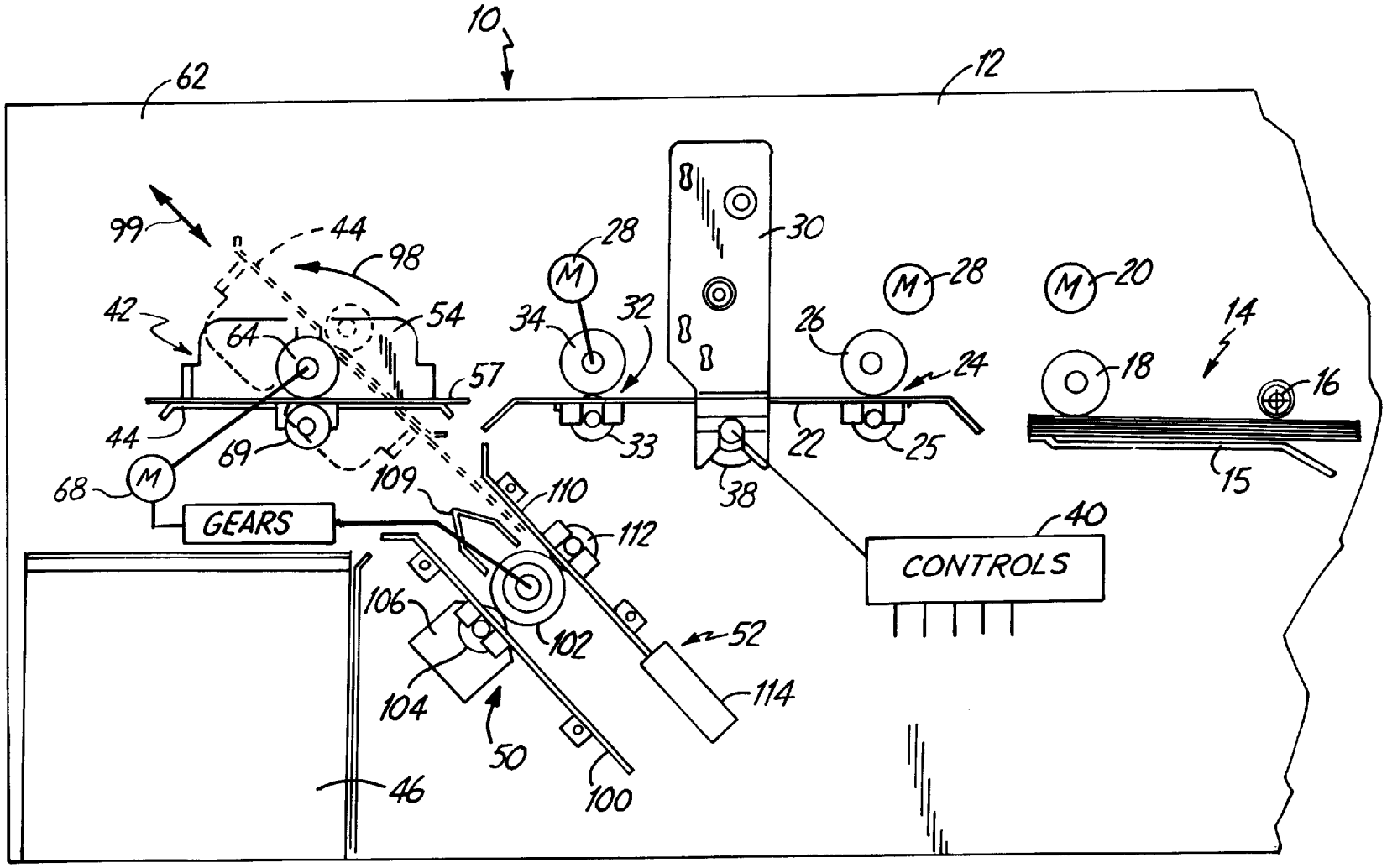
FIG. 1 is a schematic representation of a typical printer assembly including auxiliary operation stations in accordance with the present invention.

First referring to FIG. 1, a card processor, as shown, a printer assembly indicated generally at 10 includes a frame 12 on which all of the components are mounted, and because the loading and printing functions are well known in the field, and shown schematically some of the actual mounting brackets and supports and the like are omitted.

The printer assembly 10 includes an input card hopper 14 comprising a support table 15 on which standard size PVC cards can be placed. A guide roller 16 holds the stack of cards in position, and a drive roller 18 is powered from a motor 20 to move the cards from the supply. The motor 20 is powered when a card is to be delivered to the printer or graphic imaging station to drive a single card up onto a planar imaging support platform 22 and into a set of rollers 24. The roller set 24 includes a spring loaded idler roller 25, and a drive roller 26, which is powered from a stepper motor 28. This set of rollers 24 will drive a single card into a graphic imaging station or printer indicated at 30 that can be a dye-sublimation/resin thermal transfer printer, or other suitable types of printers. The printer or imaging station 30 is the first processor of the assembly. The imaging station 30 has an output roller set 32 comprising an idler roller 33 and a drive roller 34 also driven by a stepper motor 28. In the printing process, the cards can be supported on a driven roller shown at 38. The roller 38 is driven by stepper motor 28. The stepper motor 28 is used to drive rollers 26, 32 and 38 through suitable gears. Individual stepper motors can be used if desired on the interior of the printer. The stepper motor 28 can be driven in both directions of rotation so that the card can be moved back and forth along the support platform 22 for multiple passes for printing or other processing.

When one side of a card such as that shown at 57 has been printed or received an image, the rollers 33 and 34, comprising the roller set 32, will be programmed through a suitable controls indicated generally at 40 to drive the card 57 onto an indexable table assembly 42. The indexable table assembly 42 will be described in detail, but it includes an index table 44 and suitable drive devices for not only driving the card 57 but also rotating the index table 44 about the axis of a drive and mounting shaft, as will be explained.

When the operations on the card are completed, the card will be deposited in an output hopper indicated generally at 46 mounted on the frame, so that finished, printed cards can be removed from the hopper. The indexable table assembly 42 also can be rotated so that it will invert the card and move it back into the roller set 32 and into the graphic imaging station 30 to print a second side of the card, if desired.

The present invention includes auxiliary processing stations that are accessible by operation of the indexable table assembly 42, at a level that is offset from the plane of movement of the cards during input and printing. This permits additional operations to be performed on the card, subsequent to printing, without elongating the frame 12 substantially and by utilizing the space beneath the support platform 22 for the graphic imaging station.

As shown, a magnetic encoding station 50 is provided at a selected position, and a smart card encoding station 52 is provided in the same general location, but offset or spaced therefrom so that the cards can be selectively placed into the respective encoding stations.

Figure 2:
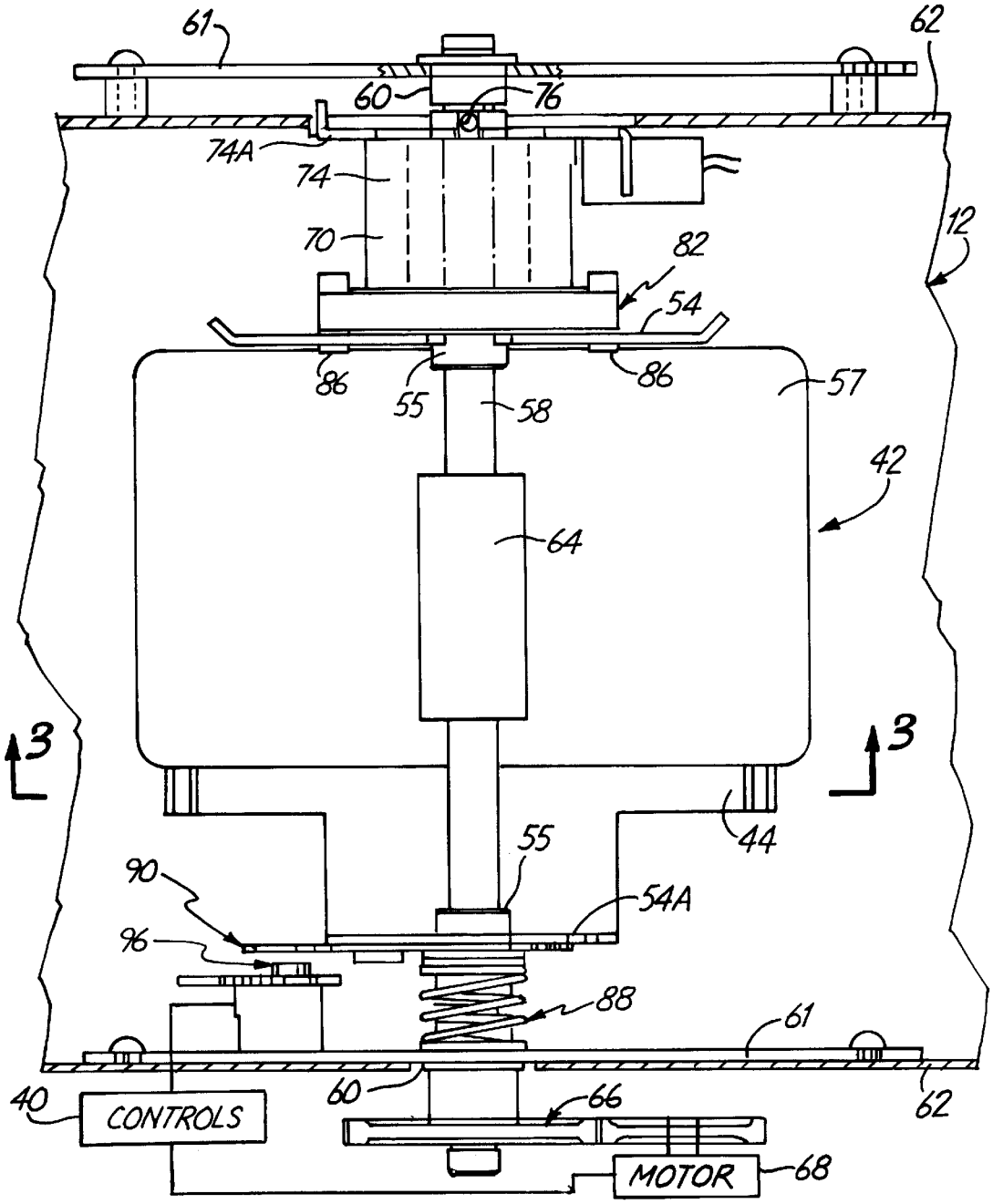
FIG. 2 is a plan view of an indexing table used with the present invention.
Figure 3:
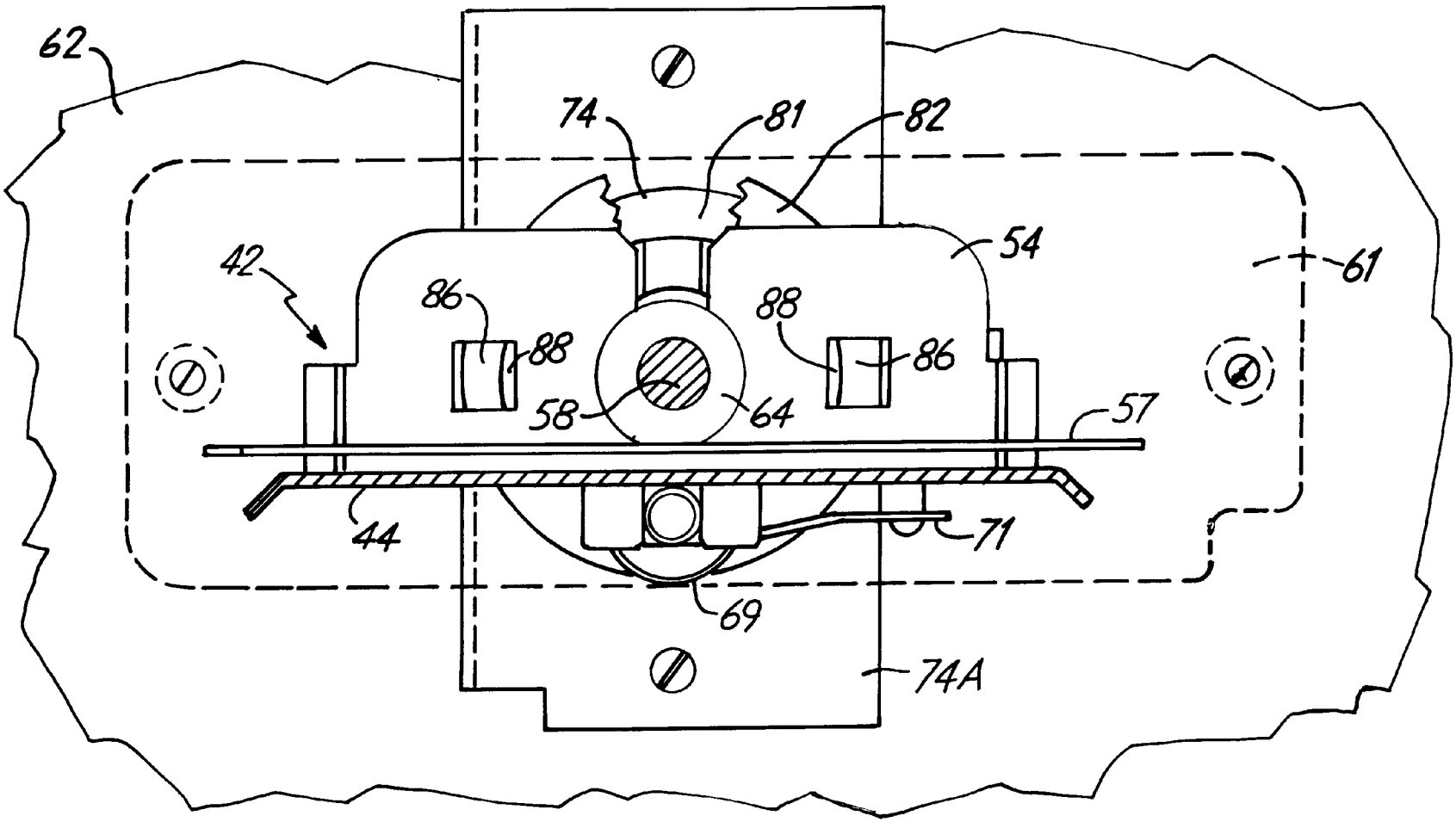
FIG. 3 is a sectional view taken as on line 3—3 in FIG. 2.
Figure 4:
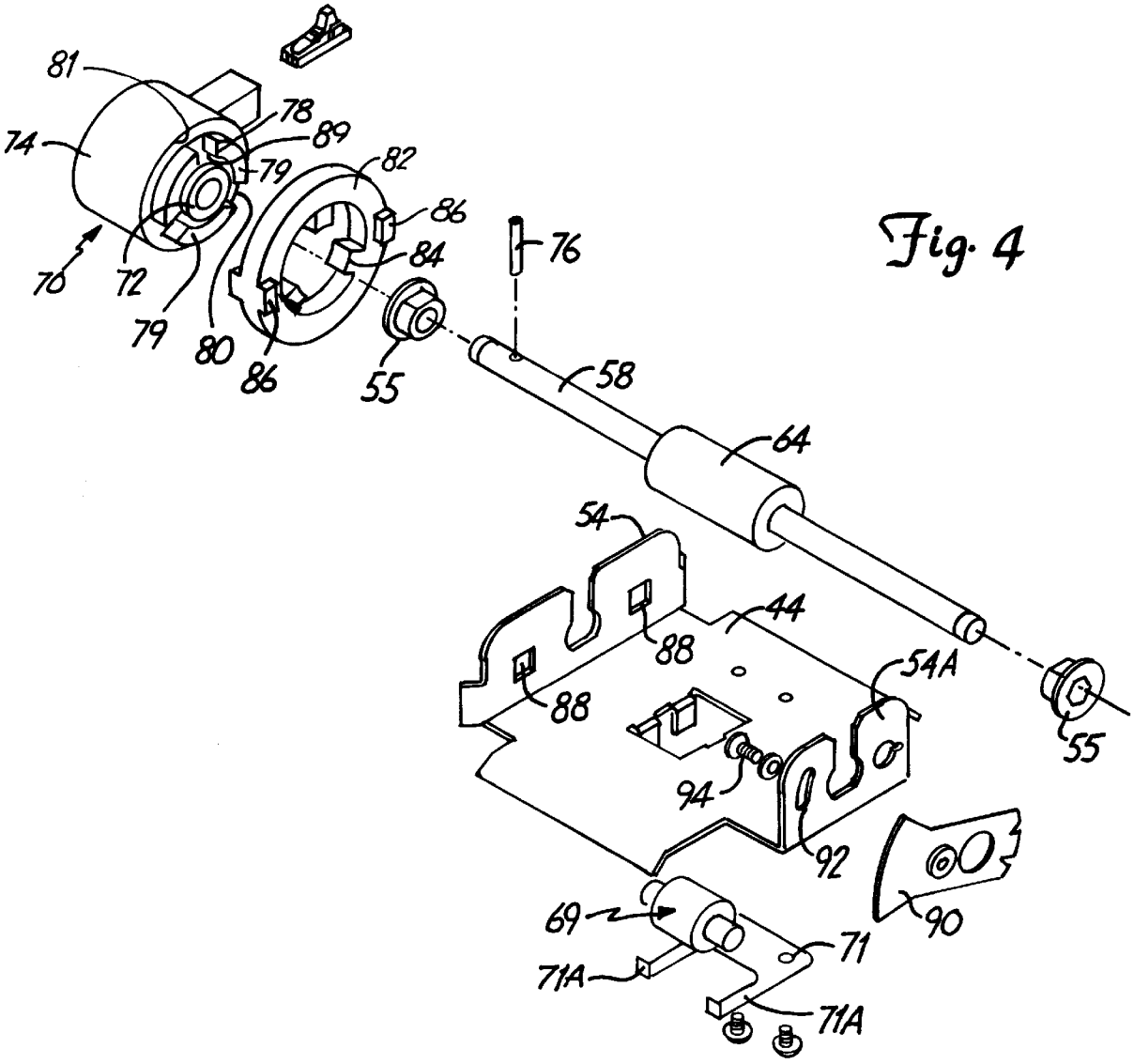
FIG. 4 is an exploded view of the indexing table of FIG. 2 to show details of its construction.

Referring to FIGS. 2, 3 and 4, the indexable table assembly or station 42 of the present invention is shown in greater detail. The indexable table 42 includes the index table 44 that is a flat plate, and which has side guide walls 54 and 54A on opposite sides thereof. The printed card 57 is shown in position on the index table 44 and as can be seen it is slightly longer than the index table and overhangs the table 44 at each end. The wall 54 provides a guide for one edge of the card 57 as it is moved onto the index table. The card 57 does not actually touch the wall 54 under normal conditions, but if the card becomes skewed, the wall 54 does act as a guide.

The index table is rotatably supported using bearing 55 (FIG. 4) on a cross shaft 58 that is suitably mounted on bearings 60 that are supported on brackets 61 that attach suitably to the side walls 62 of the frame 12. The bearings 55 fit into sockets in the walls 54 and 54A and are secured in place.

The shaft 58 has a center drive roller section 64 that has sufficient frictional characteristics to drive the card 57 when the shaft 58 is rotating and the index table 44 is held from rotating on shaft 58. The shaft 58 is driven through a gear set 66 from a stepper motor 68 responsive to controls 40 that include various inputs that program operations. The stepper motor 68 is a reversible motor controlled in a series of steps so that the direction, speed, and the amount of rotation of the shaft 58 can be precisely controlled.

It should be noted in FIG. 3 that a spring loaded idler roll 69 is mounted suitably below the index table 44 in alignment with the drive roller 64 so that the card itself is supported on the rollers. The spring load of roller 69 is achieved by having a bracket 71 (FIGS. 3 and 4) fixed to the underside of the table 44 with arms 71A that engage and support the shaft of roller 69 under a spring load.

An electric clutch assembly 70 is used for controlling rotation or non rotation of the index table 44 with shaft 58 and thus a card 57 carried the table 44 may be rotated relative to the plane of support platform 22 for the graphic imaging station about an axis parallel to that plane.

The shaft 58 passes through the bore of a hub 72 of the electric clutch 70 and the hub is drivably connected to the shaft 58 at the outer end with a suitable pin 76. When the electric clutch 70 is not energized, the shaft 58 and hub 72 will rotate inside a clutch housing 74 while supported on bearings 60. The housing 74 is mounted with a bracket 74A to the sidewall 62 of the frame 12. The roller 64 will then drive a card in whatever direction of rotation the motor 68 is rotating and as will be explained, the index table 44 is held from rotating. However, when the electric clutch 70 is energized, it drivably locks an end plate 78 to the hub 72 so that the end plate 78 rotates with the hub. The end plate 78 has raised lugs 79 that form drive slots 80 on the outer face thereof. The end plate 78 is inside the housing 74, so an annular edge surface 81 of the housing 74 at the hub end shown is exposed. An indexing spacer ring 82 has inwardly directed lugs 84 which will mate with and fit into the slots 80 so that the indexing spacer rings forms an indexing drive and is drivably coupled to the shaft 58 whenever the clutch 70 is energized.

The indexing spacer 82 has a pair of lugs 86 on the front face thereof (FIGS. 3 and 4) that fit into provided openings 88 in the side wall 54 of the index table. The spacer inverter ring 82 will effect a driving relationship to the index table 44 whenever the electric clutch 70 is energized and the stepper motor 68 is also driven to drive shaft 58. The index table 44 will then rotate with the shaft 58 about the axis of the shaft 58 until the electric clutch 70 is deenergized or released, or until the motor 68 is stopped.

The indexing spacer 82 has one side surface urged against the exposed front edge or rim of the housing 74, to the outside of the tabs or lugs 79. A spring 88 shown in FIG. 2 is positioned between one of the frame side walls 62 and the index table to urge the index table toward electric clutch 70. The spring actually bears against a sensor flag plate 90 which is adjustably fixed to the wall 54A. The sensor flag 90 is pivotally positioned around the shaft 58 at one end, and is held in place along an adjustment slot 92 on the wall 54A with a suitable screw 94. It can be adjusted along the slot 92 to a reference position and will be used in connection with an optical sensor 96 shown in FIG. 2. The optical sensor 96 is mounted on the side wall 62 of the frame with a suitable bracket.

The spring 88 bears against the wall 54A through the flag 90 and urges the index table 44, and the wall 54 toward the indexing spacer 82. The spacer 82 side surface frictionally engages the edge surface 81 of housing 74 at the annular edge to the outside of the lugs 79. The side of spacer 82 is urged into friction engagement with the edge surface 81 of housing 74. The housing 74 is fixed to side plate 62, so the friction load on indexing spacer 82 maintains the index table 44 at its desired stopped position when the electric clutch 70 is released. The shaft 58 and the roller 64 that is on the shaft can then rotate without causing the index table 44 to rotate. The roller 64 will thus rotate without disturbing the position of the table 44 as it is held by the friction against the housing 74 for the electric clutch. It should also be noted that the shaft is mounted in suitable bearings 55 on the walls 54 and 54A, so that there is little friction between the shaft itself and the indexing table 44.

When the electric clutch 70 is engaged and the stepper motor 68 is driving the shaft 58. The indexing table is rotated in the direction of the shaft driven by the stepper 68. When the clutch disengages, the shaft 58 is rotatable by the stepper motor to drive. The card that is held between the roller 64 and the idler roller 69.

The two auxiliary stations or processors for auxiliary operations that are illustrated and which are positioned in a space saving relationship relative to the plane of the support platform 22, include the magnetic encoding station 50, which has a support tray 100 mounted to the side frame members 62 in a suitable manner. The support tray 100 is positioned at a desired angle relative to the plane of the platform 22 and is adjacent the index table 44. The magnetic encoding station 50 includes a drive roller 102 that is engaged by a spring loaded idler roller 104 adjacent to a magnetic encoding head 106 that is shown schematically in line with the rollers 102 and 104. The support tray 100 is positioned so that when the index table 44 is rotated in the direction of arrow 98 in the range of 330° from the solid line position, the index table surface carrying the card 57 will be substantially aligned with the surface of the support tray 100 in the magnetic encoding station 50.

The stepper motor 68 will drive the shaft and index table 44 with the electric clutch 70 engaged until the index table 44 reaches the aligning position for the selected auxiliary processor, and the card 57 will then be aligned in position to be slid onto the tray 100 by releasing the electric clutch 70 so the index table 44 is held by index spacer 82 bearing against surface 81 of the housing 74, and driving the stepper motor 68 and shaft 58 in the proper direction of rotation. The index table 44 is held in the correct position, while the drive roller 64 will move the card onto the tray 100 or back, as shown by the double arrow 99 in FIG. 1.

Stepper motor 68 is utilized for driving the roller 102 through a gear train at the appropriate time when the end of the card has entered the "nip" of rollers 102 and 104. The stepper motor 68 will move the card to the appropriate position for encoding magnetic information on the card. The encoding will take place in response to signals from controls 40 as the card passes over the head 106. The encoded information can be software controlled.

When the encoding is done, the rollers 102 and 104 are driven by the motor 68 in a reverse direction until the card is resting on the index plate 44 and the end of the card will be engaged and the card driven by the rollers 64 and 69 back into the position desired. At that time the index table 44 can be again rotated in the direction of the arrow 98 by energizing electric clutch 70 until one end of the card is over the output hopper 46. The clutch 70 is released and the card is moved into the hopper by driving the rollers 64 and 69 with the stepper motor 68.

The index table 44 can be rotated 180° at any desired time to invert the card and send it back for printing on a second side of the card. After the second printing card, the processed card will be put into the output hopper, or further processed if designed.

The stacking of cards is controlled until the stack gets up to the top of the hopper, at which point the end of the card on the index table 44 will strike the card stack in the hopper and rotation of the index table 44 will be stopped. The flag 90, which moves with the index plate 44 will not be in front of the optical sensor 96 at the card discharge position, and after a selected length of time established by the controls 40, the controls will provide a signal indicating that the output hopper is full and needs to be emptied.

If the cards being printed are "smart" cards and include a chip for memory or the like, the card is received on the index table 44 will be rotated using the stepper motor 68 to the position shown in FIG. 1 in dotted lines, which causes the index table to be inverted and the rollers 64 and 69 will drive the "smart" card into a position adjacent to a support tray 110 carrying the "smart" card encoding station 52. A spring loaded idler roller 112 is engaging the roller 102, and with the motor 68 rotating in the correct direction, the card will be fed over to the "smart" card encoding station indicated at 114 for activating the chip, providing memory, or doing some other processing on the chip that is embedded in the "smart" card. The rollers 102 and 112 will hold the card in position, and when the "smart" card encoding is complete motor 68 is reversed and the rollers 102 and 112 cause the card to move back and engage the index table 44 to be held by the rollers 64 and 69. When the card is on the index table, the index table then can be rotated to the desired position for dropping a card in the output hopper or for another position for additional auxiliary operations that can take place in any desired location.

A tapered divider 109 is used between the trays 110 and 100, to guide the cards into the proper position when they are fed into the drive roller 102 and either the spring loaded roller 104 or the spring loaded roller 112.

Figure 5:
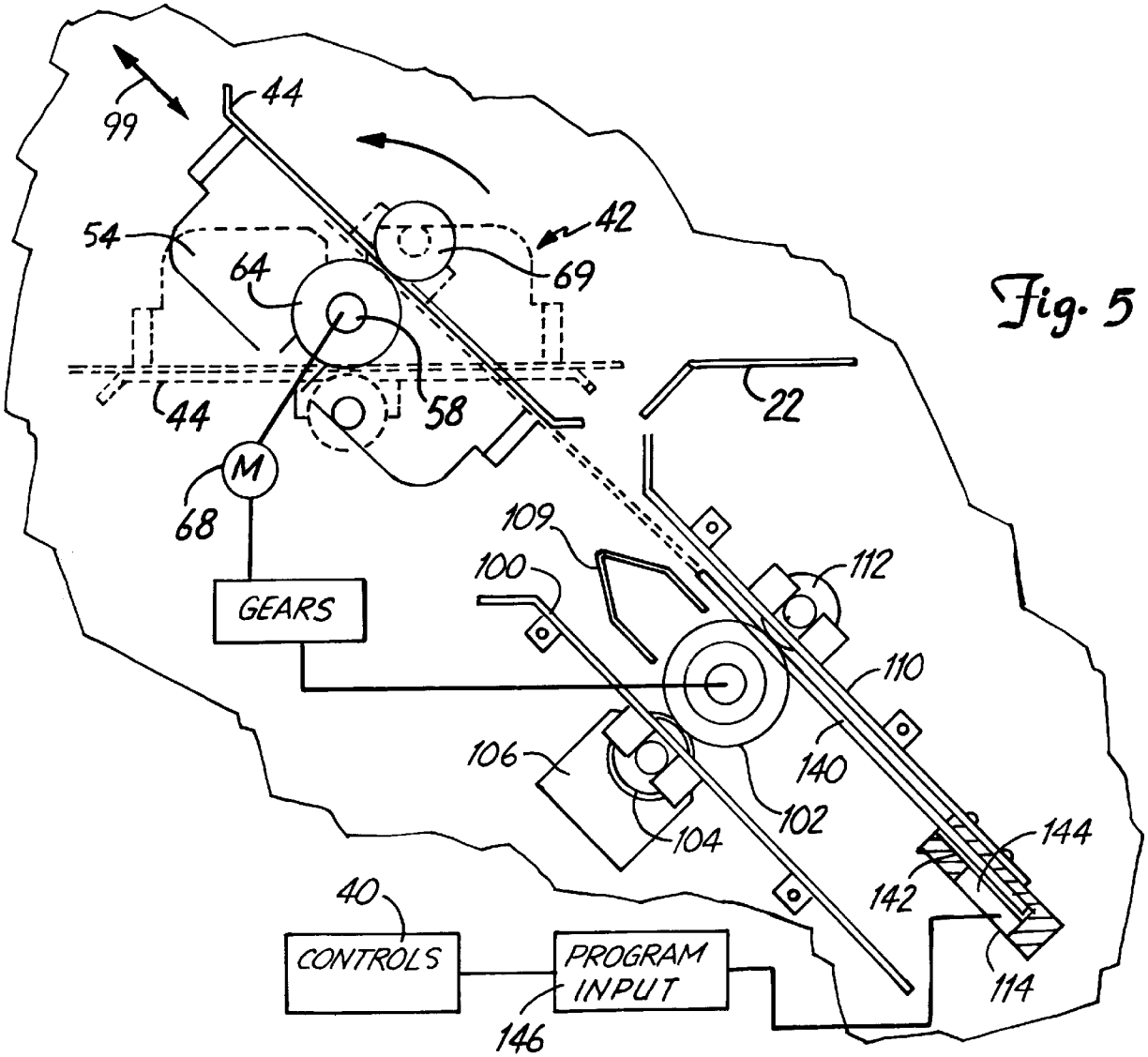
FIG. 5 is a schematic side view illustrating an identification card inserted in a smart card encoder.

In FIG. 5, the arrangement used for programming a "smart card" is illustrated. The parts are numbered in the same manner as they are in FIGS. 1–4. The operation of the index table 44 is also as previously explained. In FIG. 5, a smart card 140 is shown being driven into and removed from a slot provided in the smart card encoding station or circuitry 114. The stepper motor 68 has driven the shaft 58 and roller 64 with the electric clutch 70 engaged until the index table 44 has reached the position shown in solid lines in FIG. 5, which is the aligning position for the tray 110 and drive roller 102 and idler roller 112 for engaging the card 140.

As shown in dotted lines, the roller 64 is then powered for driving the card 140 as shown by the dotted line path in FIG. 5 toward rollers 102 and 112, as guided by the tray 110. When the rollers 102 and 112 grip the card 140, it will be released by the rollers 64 and 69. Then, the stepper motor 68 controls the positioning of the card 140 and the card will be inserted into a slot 142 formed at an input end for the smart card encoding station 114. The slot 142 will guide the end of the card 140 that contains the chip, into position where a circuit, indicated generally at 144 will be activated under a programmed input from an input 146 operated by the controls 40 to encode information onto the chip carried by the smart card 140. After that, the stepper motor 68 will be reversed and the card 140 will be backed out of the slot 142 in a reverse direction, until the card engages the rollers 64 and 69 at which time the rollers 64 and 69 will drive the card into its desired position on the index table. The clutch 70 will then be energized and the motor 68 operated to cause the index table to rotate to its home position for transferring the card to a storage hopper, or to other stations for further operations on the card.

The auxiliary operations performed by auxiliary processors that may take place include but are not limited to, lamination of the card with a suitable plastic material, hole punching, some additional printing on the card, or envelope stuffing.

The index table 44 permits both sides of the card to be printed on, by running the card out onto the index table, turning the table approximately 180° and running the card back into the printer or graphics imaging station 30.

The spring loading on the idler rollers for all sets of rollers can be similar to that shown in FIG. 3 for the spring loaded roller 69. Other arrangements also can be used.

Figure 6:
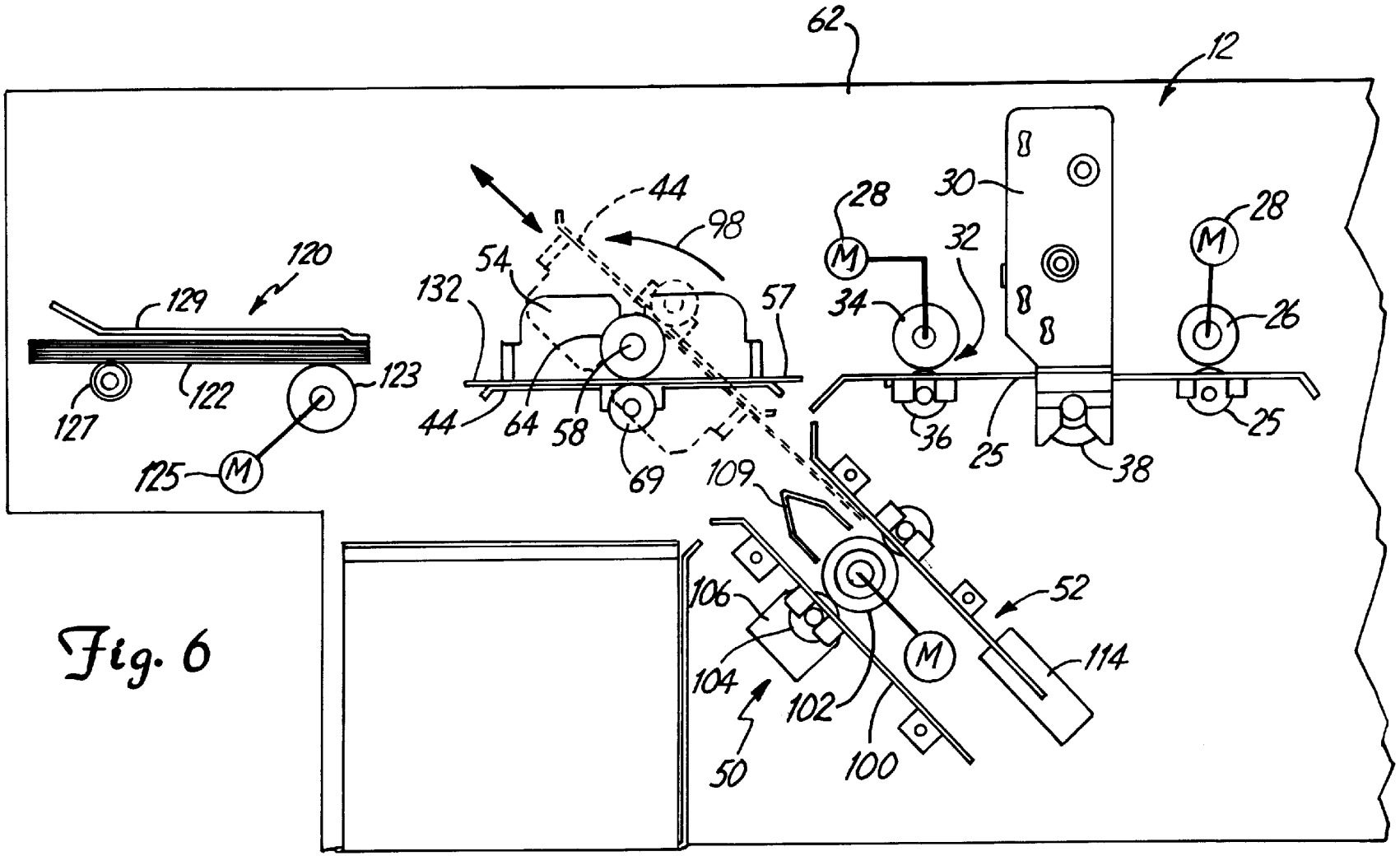
FIG. 6 is a schematic side view of a printer similar to FIG. 1, but modified as to location of the card supply.

FIG. 6 shows an alternate configuration in which the card input hopper is on the opposite side of the indexing assembly 42 from the graphic or printing station 30.

In FIG. 6 like parts have been numbered identically to the showing in FIG. 1, but the input hopper in this instance is shown at 120, and a stack of cards 122 is supported on a drive roller 123 and an idler roller 127. The position of input hopper could be at any desired radial position about shaft 58 to accommodate various designs. The drive roller 123 is driven with a suitable motor 125, and an idler roller 127. A guide plate 129 is provided at the top of the stack, and the individual cards are first fed onto the index table 44 such as that card shown at 132 in FIG. 6.

It can be seen that the card then can be shifted over to the graphic imaging station by driving the motor 36 and the roller set 32, and then moved for printing as desired until the printing is done. The card then can be fed back onto the index table 44 and the operation as previously explained can continue. The magnetic encoding stations and "smart" card encoding stations are also shown in FIG. 6.

The input hopper thus can be located in different positions, and the graphic imaging station 30 can be any desired type. The input hopper may be positioned at an angle to the plane of the card in the processing station to reduce the foot print 4 of the frame 12. The index table 44 can be included and the hopper aligned to feed cards onto the table to reduce overall length.

The index table 44 is enabled to index to any desired position for receiving a card, turning it over, and placing it into a path that is offset from the main plane of operations during the printing sequence. In this way space is saved, and fast, accurate operation is assured.

Although the present invention has been described with reference to preferred embodiments, workers skilled in the art will recognize that changes may be made in form and detail without departing from the spirit and scope of the invention.

What is claimed is:

1. A card processing assembly comprising:

a card feeder, a first card processor, and an index table for receiving a card from the first card processor, said feeder, said first card processor and said index table lying substantially along a first plane for operations on the card;

a drive for driving the card along the index table at selected times;

said drive being operable to permit rotation of the index table about an axis while the card is held on the index table; and a second processor for secondarily processing said card and positioned at a level offset from the first plane, said index table being indexable about the axis to place a card in the second processor.

2. The processing assembly of claim 1, wherein said first processor comprises a printer.

3. The processing assembly of claim 2 and a third processor offset from the first plane, said index table being indexable to position to place a card in the third processor at selected times.

4. The processing assembly of claim 2, wherein said second processor comprises a magnetic encoding station, and said third processor comprises a smart card encoding station.

5. The processing assembly of claim 1, wherein the drive includes driven rotating rollers to selectively drive the card between the first processor and the index table, and between the index table and the second processor.

6. The processing assembly of claim 5, wherein the index table establishes a plane of the card that is substantially radially extending relative to the axis of rotation of the index table.

7. The processing assembly of claim 1, wherein the assembly includes an input hopper mounted on an opposite side of the index table from the first processor.

8. The processing assembly of claim 1, wherein said index table is mounted to permit it to continuously rotate about the axis of rotation of the index table, said axis being the axis of a shaft of a roller associated with the index table for driving a card onto and from the index table.

9. The processing assembly of claim 8, wherein said index table has an indexing mechanism capable of stopping the index table at any desired rotational position about the axis of rotation.

10. The processing assembly of claim 1 wherein the assembly includes an output hopper for cards that have been processed, said index table being indexed to position to feed the processed cards into the output hopper, cards stacked in said output hopper being in position to engage the index table in its rotational path when the hopper is full of cards, and a sensor for sensing when the indexing table engages a stack of cards in the hopper.

11. The processing assembly of claim 1, wherein one of the processors comprises an encoding circuit for a card having an electric circuit thereon, including a housing having a receptacle for receiving an end portion of such card, and a drive to insert the card into the receptacle and reverse direction of the card to remove it from the receptacle.

12. A method of processing presized cards by performing at least two operations on the card, comprising:

moving a card into a first processor for performing a first operation on the card, moving the card to an indexing table and supporting the card thereon in a support plane substantially aligning with a plane of movement of the card in the first processor;

indexing the indexing table to a position the card in a plane oblique to the support plane; and moving the card along the oblique plane to a second processor offset from the plane of movement of the card in the first processor.

13. The method of claim 12, wherein moving the card along the oblique plane comprises moving the card along the oblique plane in a first direction to the second processor and subsequently moving the card in a second opposite direction back to the indexing table.

14. The method of claim 12, wherein the second processor comprises an encoding circuit for programming a card carrying a circuit chip thereon, said encoding circuit being in a housing have an input slot of size to receive an end portion of the card, and the moving step comprises moving the end portion of the card into the slot for programming and reversing direction of movement of the card to remove the card from the slot after programming.

15. The method of claim 12 further including moving the card from the second processor back to the indexing table subsequent to moving the card to the second processor, indexing the indexing table to a position for discharging the card, and discharging the card from the indexing table into a hopper.

16. The method of claim 12 further including providing a drive roller for driving cards on the indexing table, and providing a releasable and engageable brake and clutch mechanism between the drive roller and the indexing table which is engageable to cause the indexing table to rotate with the drive roller, and when the clutch is released the brake providing a force holding the indexing table from rotating.

17. A card processing assembly having at least one processor for operations on a card carrying a programmable chip comprising:

a card processor supporting a card for movement along a support plane to provide an operation on the card;

the processor having a slot substantially aligning with a plane of a card on the support plane and for driving the card into the slot of the processor and reversing movement of the card to remove it from the slot after processing, said processor comprising a circuit for programming the programmable chip carried on the card to be processed.

18. A card processing assembly comprising:

a card feeder, a first card processor, and an index table for receiving a card from the first card processor, said feeder, said first card processor and said index table supporting a card for movement substantially along a first plane for operations on the card;

a drive for driving the card along the index table at selected times;

an input hopper mounted on the assembly on an opposite side of the index table from the first processor and connect to provide cards to the card feeder;

said drive being operable to permit rotation of the index table about an axis while the card is held on the index table; and a second processor for secondarily processing said card and positioned at a level offset from the first plane, said index table being indexable about the axis to place a card in the second processor.

19. A card processing assembly comprising:

a card feeder, a first card processor, and an index table for receiving a card from the first card processor, said feeder, said first card processor and said index table operating to move a card substantially along a first plane for operations on the card by the first processor;

a drive for driving the card along the index table at selected times including a drive roller associated with the index table for driving a card onto and from the index table;

said drive being operable to permit rotation of the index table about an axis while the card is held in the drive, said index table being mounted to permit it to continuously rotate about the axis of rotation of the index table, said axis being the axis of a shaft of the drive roller associated with the index table; and a second processor for secondarily processing said card and positioned to support a card for processing on a plane inclined from the first plane, said index table being indexable about the axis to place a card in the second processor.

20. A card processing assembly comprising:

a card feeder, a first card processor, and an index table for receiving a card from the first card processor, said feeder, said first card processor and said index table lying substantially along a first plane for operations on the card;

a drive for driving the received card along the index table at selected times;

said drive being operable to permit rotation of the index table about an axis while the card is held on the index table;

a second processor for secondarily processing said card and positioned at a level offset from the first plane, said index table being indexable about the axis to place a card in the second processor;

an output hopper for cards that have been processed, said index table being indexed to position to feed the processed cards into the output hopper, cards stacked in said output hopper being in position to engage the index table in its rotational path when the hopper is full of cards, and a sensor for sensing when the indexing table engages a stack of cards in the hopper.

21. A card processing assembly comprising:

a card feeder, a first card processor, and an index table for receiving a card from the first card processor, said feeder, said first card processor and said index table moving the card substantially along a first path for operations on the card;

a first drive for driving the card along the index table at selected times;

said first drive is being operable to permit rotation of the index table about an axis while the card is held in the drive;

a second processor for secondarily processing said card and positioned to process a card at a location offset from the first path, said index table being indexable about the axis to place a card in the second processor; and one of the processors comprising an encoding circuit for a card having an electric circuit chip thereon, including a housing having a slot for receiving an end portion of the card, and a second drive to insert the card into the slot and to reverse direction of the card to remove it from the slot.

* * * * *

UNITED STATES PATENT AND TRADEMARK OFFICE

CERTIFICATE OF CORRECTION

PATENT NO. : 5,941,522

DATED : August 24, 1999

INVENTOR(S) : Erick Hagstrom et al.

It is certified that error appears in the above-identified patent and that said Letters Patent is hereby corrected as shown below:

Column 8, line 12, cancel "have" and insert --having--.

Column 8, line 54, cancel "connect" and insert --connected--.

Signed and Sealed this

Ninth Day of May, 2000

*Attest:*

Q. TODD DICKINSON

*Attesting Officer*

*Director of Patents and Trademarks*